US006524002B2

(12) United States Patent
Tomic

(10) Patent No.: US 6,524,002 B2
(45) Date of Patent: Feb. 25, 2003

(54) SLIDER DEVICE, PACKAGES, AND METHODS

(75) Inventor: Mladomir Tomic, Appleton, WI (US)

(73) Assignee: Reynolds Consumer Products, Inc., Appleton, WI (US)

( * ) Notice: Subject to any disclaimer, the term of this patent is extended or adjusted under 35 U.S.C. 154(b) by 0 days.

(21) Appl. No.: 09/918,982

(22) Filed: Jul. 31, 2001

(65) Prior Publication Data

US 2002/0012479 A1 Jan. 31, 2002

Related U.S. Application Data

(60) Provisional application No. 60/222,132, filed on Jul. 31, 2000.

(51) Int. Cl.[7] ..... B65D 33/16

(52) U.S. Cl. ..... 383/64; 383/5; 383/61.2; 383/204; 24/399; 24/400

(58) Field of Search ..... 383/61.2, 5, 64, 383/204; 24/399, 400

(56) References Cited

U.S. PATENT DOCUMENTS

| | | | | |
|---|---|---|---|---|
| 3,713,923 A | | 1/1973 | Laguerre | |
| 3,790,992 A | * | 2/1974 | Herz | 156/251 |
| 4,262,395 A | | 4/1981 | Kosky | |
| 4,337,889 A | | 7/1982 | Moertel | |
| 4,883,329 A | | 11/1989 | Flannery et al. | |
| 4,890,935 A | | 1/1990 | Ausnit et al. | |
| 5,007,142 A | | 4/1991 | Herrington | |
| 5,007,143 A | | 4/1991 | Herrington | |
| 5,010,627 A | | 4/1991 | Herrington et al. | |
| 5,020,194 A | | 6/1991 | Herrington et al. | |
| 5,063,644 A | | 11/1991 | Herrington et al. | |
| 5,067,208 A | | 11/1991 | Herrington, Jr. et al. | |
| 5,070,583 A | | 12/1991 | Herrington | |
| 5,088,971 A | | 2/1992 | Herrington | |

(List continued on next page.)

FOREIGN PATENT DOCUMENTS

| | | |
|---|---|---|
| WO | WO 99/62780 | 12/1999 |
| WO | WO 99/62781 | 12/1999 |
| WO | WO 99/65353 | 12/1999 |

*Primary Examiner*—Jes F. Pascua
(74) *Attorney, Agent, or Firm*—Mara E. Liepa; Tracey D. Beiriger

(57) ABSTRACT

A slider device for use with a resealable package includes a top wall with first and second ends, a spreader depending from the top wall, a first sidewall, a second sidewall, a first hook construction extending from the first sidewall, a second hook construction extending from the second sidewall, and a guide construction. The first and second hook constructions have sloped or tapered surfaces that facilitate mounting of the slider device on a reclosable closure construction, such as a zipper arrangement. Methods of assembling and operation are described.

28 Claims, 10 Drawing Sheets

U.S. PATENT DOCUMENTS

| | | | | |
|---|---|---|---|---|
| D325,547 | S | | 4/1992 | Saito et al. |
| 5,131,121 | A | | 7/1992 | Herrington, Jr. et al. |
| 5,161,286 | A | | 11/1992 | Herrington, Jr. et al. |
| 5,189,764 | A | | 3/1993 | Herrington et al. |
| 5,211,482 | A | | 5/1993 | Tilman |
| 5,283,932 | A | | 2/1994 | Richardson et al. |
| 5,301,394 | A | | 4/1994 | Richardson et al. |
| 5,301,395 | A | | 4/1994 | Richardson et al. |
| 5,442,837 | A | | 8/1995 | Morgan |
| 5,448,808 | A | | 9/1995 | Gross |
| 5,636,415 | A | | 6/1997 | James |
| 5,638,586 | A | | 6/1997 | Malin et al. |
| D380,988 | S | | 7/1997 | Mizuno |
| 5,664,299 | A | | 9/1997 | Porchia et al. |
| 5,669,715 | A | | 9/1997 | Dobreski et al. |
| 5,713,669 | A | | 2/1998 | Thomas et al. |
| 5,722,128 | A | | 3/1998 | Toney et al. |
| 5,775,812 | A | | 7/1998 | St. Phillips et al. |
| 5,833,791 | A | | 11/1998 | Bryniarski et al. |
| 5,867,875 | A | | 2/1999 | Beck et al. |
| 5,896,627 | A | | 4/1999 | Cappel et al. |
| 5,911,508 | A | | 6/1999 | Dobreski et al. |
| 5,924,173 | A | | 7/1999 | Dobreski et al. |
| 5,950,285 | A | * | 9/1999 | Porchia et al. ..... 24/390 |
| 5,964,532 | A | | 10/1999 | St. Phillips et al. |
| 6,010,244 | A | | 1/2000 | Dobreski et al. |
| 6,014,795 | A | | 1/2000 | McMahon et al. |
| 6,257,763 | B1 | * | 7/2001 | Stolmeier et al. ..... 383/5 |
| 6,287,001 | B1 | * | 9/2001 | Buchman ..... 24/400 |
| 6,293,701 | B1 | * | 9/2001 | Tomic ..... 24/400 |

* cited by examiner

SLIDER DEVICE, PACKAGES, AND METHODS

Priority under 35 U.S.C. §119(e) is claimed to provisional application serial No. 60/222,132, filed on Jul. 31, 2000, and entitled "SLIDER DEVICE, AND METHODS". The complete disclosure of application No. 60/222,132 is incorporated by reference herein.

FIELD OF THE INVENTION

The present invention generally relates to slider devices for use with closure arrangements, such as those used for resealable packages, such as, plastic bags. In particular, the present invention relates to a slider device for use with zipper closure arrangements.

BACKGROUND

Many packaging applications use resealable containers to store or enclose various types of articles and materials. These packages may be used to store food products, non-food consumer goods, medical supplies, waste materials, and many other articles. Resealable packages are convenient in that they can be closed and resealed after the initial opening to preserve the enclosed contents. The need to locate a storage container for the unused portion of the products in the package is thus avoided. In some instances, providing products in resealable packages appreciably enhances the marketability of those products.

Some types of resealable packages are opened and closed using a slider device. The slider device typically includes a separator or spreader-type structure at one end that opens a closure mechanism, having profiled elements or closure profiles, when the slider device travels in a first direction along the mechanism. The sidewalls of the slider device are configured so that the sidewalls engage the closure profiles and progressively move them into engagement to close the resealable package when the slider device is moved along the closure mechanism in a direction opposite the first direction.

Improvements in the design and manufacture of closure mechanisms and slider devices are desirable.

SUMMARY OF THE DISCLOSURE

In one aspect a slider device is disclosed for use with a resealable zipper closure mechanism having a first closure profile and a second closure profile. One preferred slider device includes a top wall; a spreader depending from the top wall; first and second sidewalls; first and second hook constructions; and a guide construction projecting beyond at least one of a first end and a second end of the first sidewall. The first and second hook constructions have lower deflection surfaces, for example, to facilitate mounting of the slider device onto a zipper closure mechanism. The deflection surfaces also aid in aligning the slider device onto the closure mechanism. Each deflection surface is generally at an angle of about 40 to 50 degrees from the top wall. The first and second hook constructions further have engaging surfaces to retain the zipper closure mechanism within the slider device.

The first end of the slider device can be wider than the second end of the slider device. In other embodiments, the first end and second end have essentially the same width. In one embodiment when the ends have different widths, the wider end of the slider device, when the slider device is being moved in a direction along a zipper closure to close the zipper closure, is the leading end. Thus, when the slider device is moved in the opposite direction along the zipper closure to open the zipper closure, the wider end is the trailing end and the narrow end is the leading end.

Flexible packages are provided that include a package surround wall having first and second side panels and a mouth therebetween. The side panels are joined at side edges; often, the side edges include side seals. A reclosable zipper closure is provided along the mouth for selective opening and closing of the mouth. A slider device is operably mounted on the zipper closure of the package. A tamper-evident structure can be provided encasing the slider device and zipper closure. One preferred zipper closure includes first and second closure profiles defining first and second shoulders, respectively. First and second tapered hook constructions on the slider device are included for sliding along the first and second shoulders, respectively. A guide construction can be provided on the slider device.

Methods for mounting the slider device onto the flexible package are described, as are methods of using a resealable package having the slider device. Methods of using the slider device include a step of moving a slider device along a mouth a first direction from a side seal of the resealable package until a projecting finger on the slider device engages a first side seal on the resealable package. Packages and slider devices as described herein may be used in this method.

DETAILED DESCRIPTION

Figure 1:
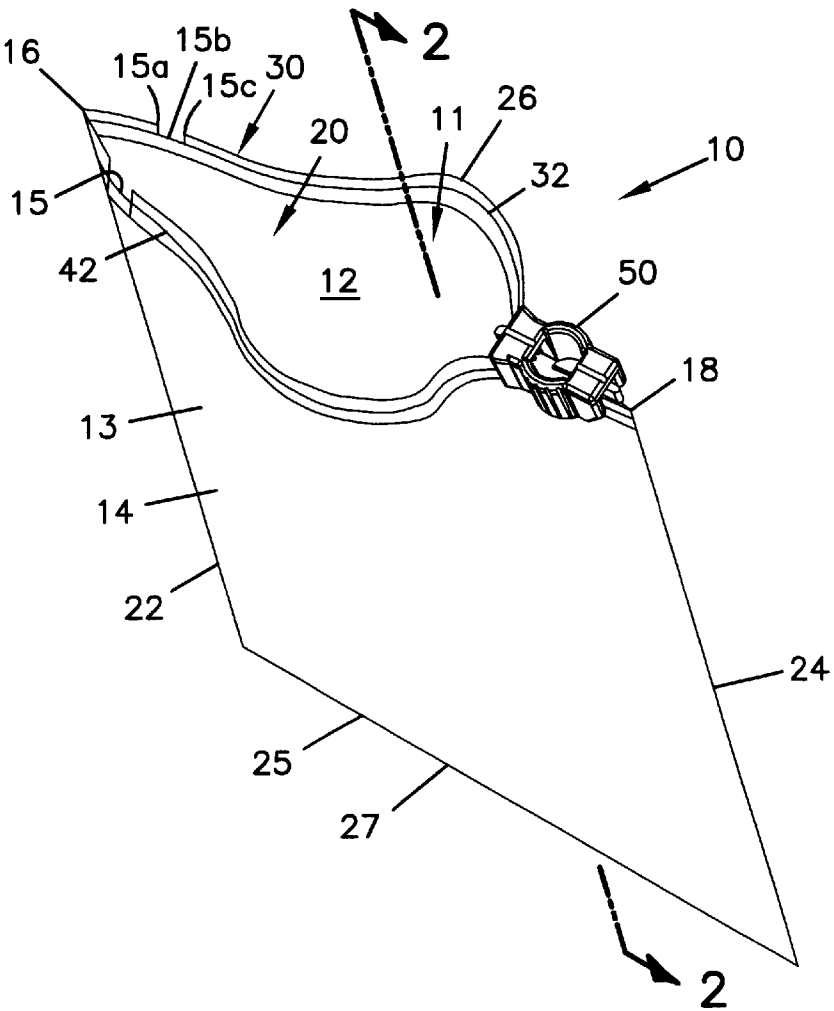
FIG. 1 is a perspective, schematic view of a first embodiment of a flexible, resealable package having a slider device, constructed according to principles of this disclosure.
Figure 2:
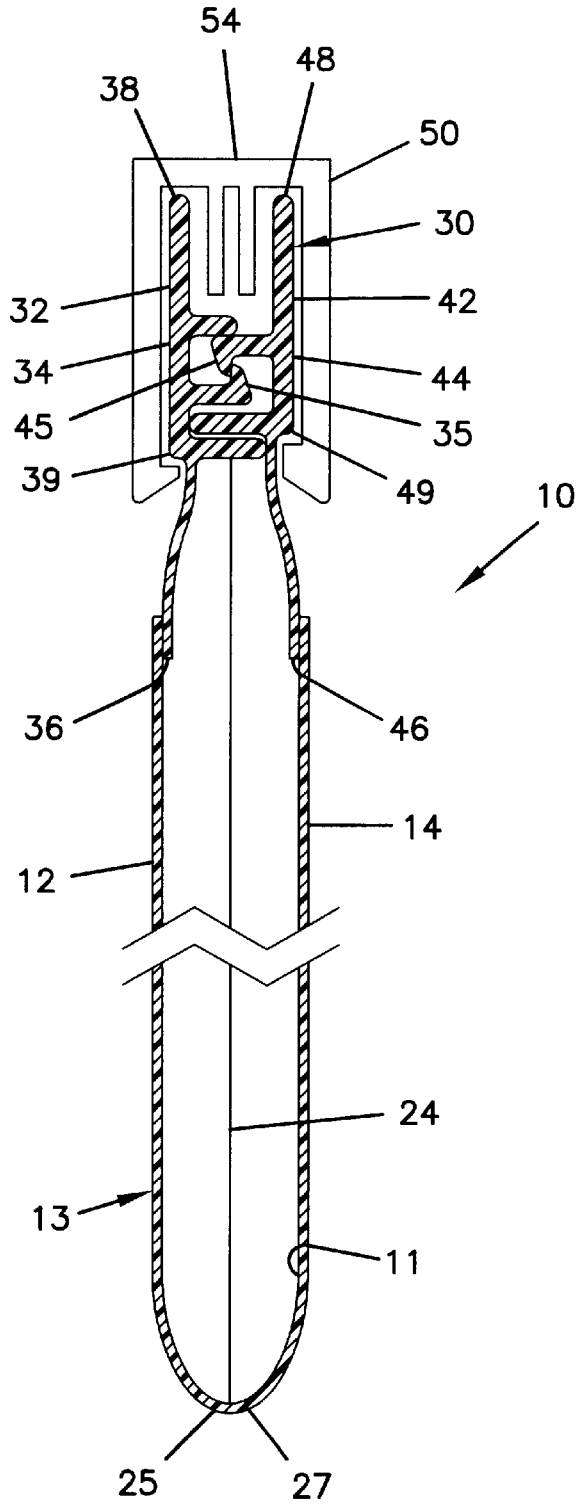
FIG. 2 is a cross-sectional view of the resealable package of FIG. 1, taken along line 2—2.

Attention is directed to FIGS. 1 and 2, which illustrate an example packaging arrangement in the form of a resealable, flexible package 10, for example, a polymeric package such as a plastic bag. Package 10 has a resealable closure mechanism 30, which includes interlocking profiled elements attached to package surrounding wall 13. Package surrounding wall 13 is typically made from a flexible, polymeric, plastic film, and includes first and second opposed panel sections 12, 14. With some manufacturing applications, the first and second panel sections 12, 14 are heat-sealed together along two side edges 22, 24 and meet at a fold line 25 in order to form a three-edged containment section for a product within an interior 11 of the package 10. In the embodiment shown, the fold line 25 comprises the bottom edge 27 of the package 10. In another embodiment, first and second panel sections 12, 14 are folded at side edges 22, 24 and heat-sealed at bottom edge 27; typically, such a package includes a fin seal (not shown) within one of panel sections 12, 14. In yet another embodiment, the panel sections 12, 14 are folded at one side edge, for example, first side edge 22, and heat-sealed at second side edge 24 and at bottom edge 27. Alternatively, two separate panel sections 12, 14 of plastic film may be used and heat-sealed together along both side edges 22, 24 and at the bottom edge 27. In some embodiments, the bottom edge 27 of the package 10 may be left open to allow filling of package 10 through bottom edge 27; bottom edge 27 is then sealed after product has been positioned in the interior 11 of the package 10.

Access is provided to the interior 11 of the package 10 through a mouth 20 at a top edge 26 of the package. In the particular embodiment shown in FIG. 1, the mouth 20 extends the width of the package 10, from first side edge 22 to second side edge 24.

The resealable closure mechanism 30 is illustrated in FIG. 1 at the mouth 20 of the flexible package 10. In the embodiment shown, the resealable closure mechanism 30 extends the width of the mouth 20 at top edge 26. Alternatively, the closure mechanism 30 could be positioned on the package 10 at a location different from the top edge 26 of the package 10, depending on the application needs for the package 10.

The resealable closure mechanism 30 can be one of a variety of closure mechanisms. In the particular embodiment illustrated in FIG. 2, the resealable closure mechanism 30 is shown in the specific form of a zipper-type closure mechanism. By the term "zipper-type closure mechanism," it is meant a structure having opposite interlocking or mating profiled elements that under the application of pressure will interlock and close the region between the profiles.

In particular, the zipper-type closure mechanism in FIG. 2 is an illustration of one example of a resealable closure mechanism 30. The closure mechanism 30 includes an elongated first closure profile 32 and an elongated second closure profile 42. Typically, the closure profiles 32, 42 are manufactured separately from each other. In other embodiments, the two closure profiles 32, 42 can be manufactured as a single structure and then slit or otherwise separated. Typically, the resealable closure mechanism 30 is made of conventional materials, such as a polymeric, plastic material, for example, polyethylene, polypropylene, or PVC. In one example embodiment, the closure arrangement illustrated in FIG. 2 is manufactured using conventional extrusion and heat sealing techniques.

Still in reference to FIG. 2, the preferred first closure profile 32 includes a base strip 34, a sealing flange or bonding strip 36, a first mating closure member 35, and an upper flange or distal end 38. The mating closure member 35 extends from the base strip 34 and generally projects from the base strip 34. The sealing flange 36 depends or extends downward from the base strip 34 and has sufficient structure so that it can be attached to a first panel section, such as the first panel section 12 of the package 10 shown in FIG. 2. The intersection of the base strip 34 and sealing flange 36 defines a first shoulder 39.

The preferred second closure profile 42 includes a base strip 44, a bonding strip or sealing flange 46, a second mating closure member 45, and an upper flange or distal end 48. The mating closure member 45 extends from the base strip 44 and is generally projecting from the base strip 44. The sealing flange 46 depends or extends downward from the base strip 44 and can be attached to a second panel section, such as the second panel section 14 of package 10 shown in FIG. 2. A shoulder 49, analogous to the shoulder 39, is formed at the corner of the sealing flange 46 and base strip 44.

The first and second closure profiles 32, 42 are designed to engage with one another to form the resealable closure mechanism 30. In particular, the first and second mating closure members 35, 45 are designed to mate and engage with one another. Pressure is applied to the closure profiles 32, 42 as they engage to form the openable sealed closure mechanism 30. Pulling the first closure profile 32 and the second closure profile 42 away from each other causes the two closure profiles 32, 42 to disengage, opening the package 10 of FIGS. 1 and 2. This provides access to the contents of the package 10 through the mouth 20 (FIG. 1).

The closure profiles 32, 42 can be sealed together at their ends, such as at regions 16, 18 of FIG. 1 at side edges 22, 24, to further aid in aligning the closure profiles 32, 42 for interlocking. Regions 16, 18 can be areas of crushed or melted material that keeps slider device 50 from sliding off the end of closure mechanism 30; preferably, regions 16, 18 are formed by ultrasonic crushing.

In FIG. 1, note that there is a cutout or notch 15 formed in the upper flanges 38, 48 (FIG. 2) of the resealable closure mechanism 30. The preferred notch 15 includes two straight edges or sides 15*a*, 15*b*, generally perpendicular to each other, and a side 15*c* that extends at, in a preferred embodiment, an oblique angle relative to side 15*b*. By "oblique angle", it is meant an angle that is not substantially perpendicular or straight. The side 15*a* preferably is generally parallel to side edge 22 and the side 15*b* preferably is generally parallel to the bottom edge 27. The side 15*c* can extend at an angle relative to side 15*b* of at least 30 degrees, typically about 100 to 150 degrees, typically no greater than about 160 degrees, and in the preferred embodiment about 135 degrees. The shape of notch 15, defined by sides 15*a*, 15*b*, 15*c*, can generally be labeled a rhombus. As to be explained in further detail below, the notch 15 serves as a "parking place" for a slider device 50 and also facilitates mounting the slider device 50 onto the resealable package 10 during initial assembly. In addition, the edge 15*a* closest to the side edge 22 helps to create a stop member for the slider device 50. Further, the angle that the side 15*c* extends helps to reduce friction between the slider device 50 and the resealable closure mechanism 30 when the slider device 50 is being moved from the notch 15 to open the closure mechanism 30. This contributes to an easier opening, more convenient package 10.

Figure 13:
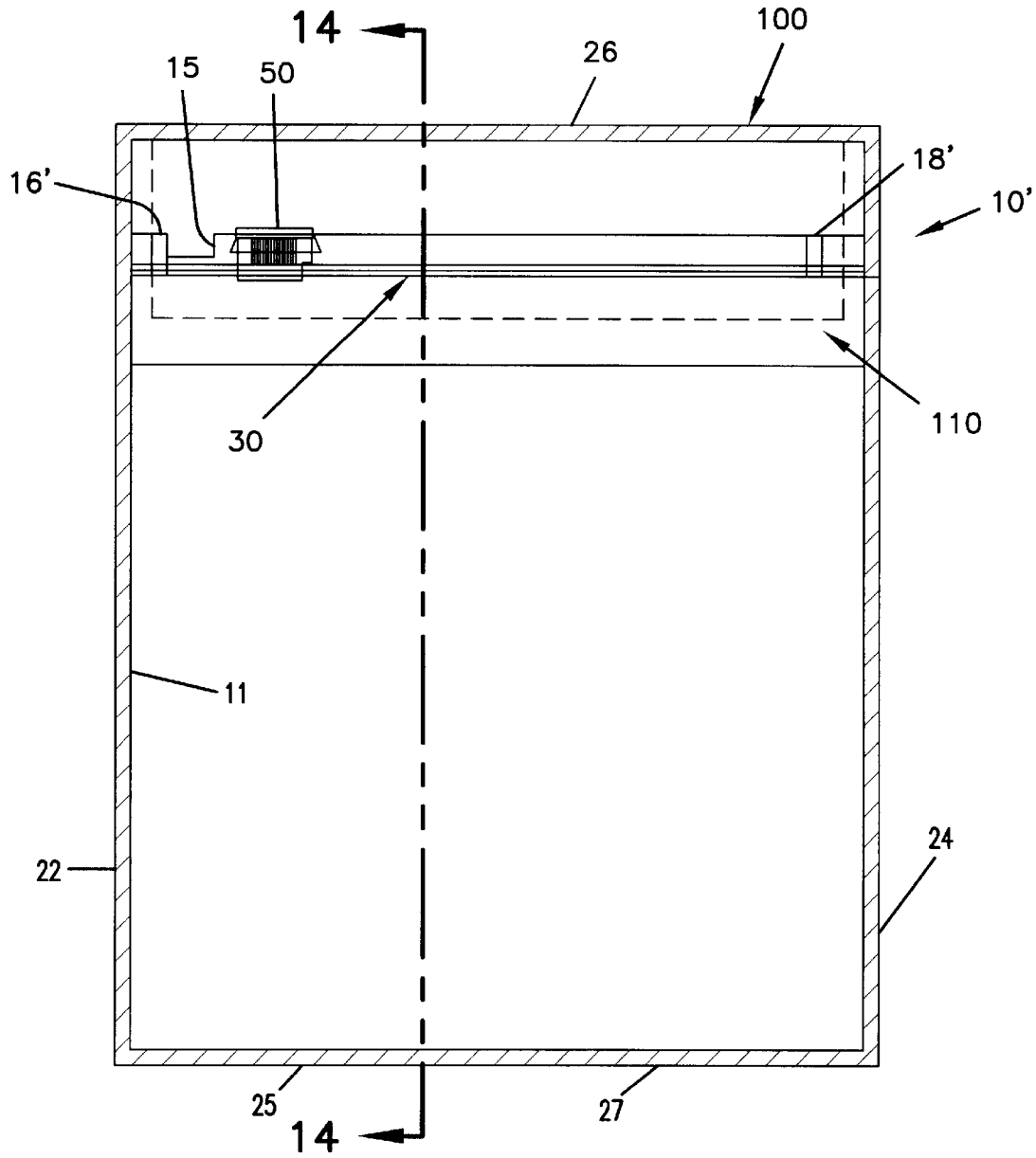
FIG. 13 is a schematic front plan view of a second embodiment of a reclosable package having the slider device shown in FIGS. 3 through 9.
Figure 14:
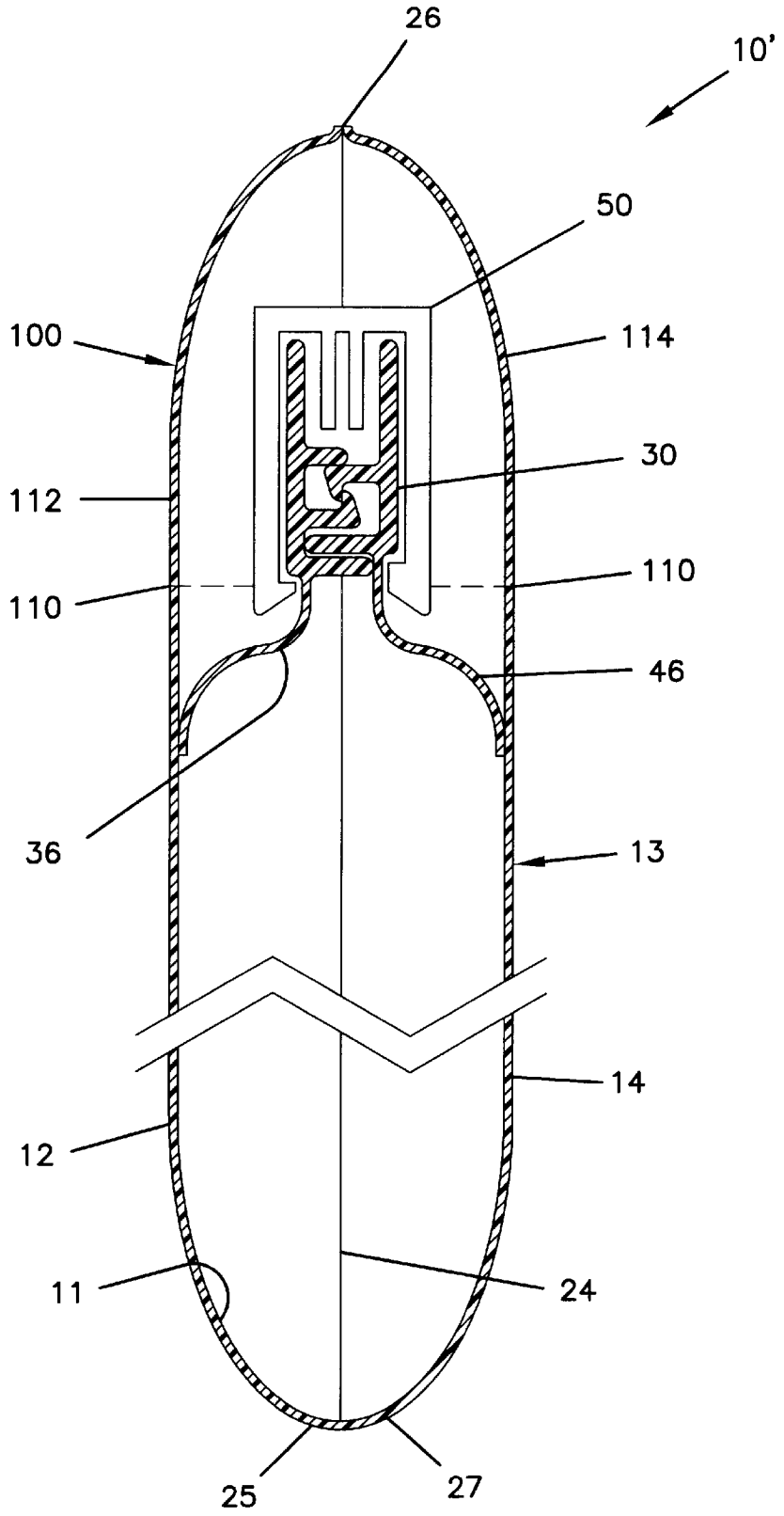
FIG. 14 is a schematic cross-sectional view of the package taken along line 14—14 of FIG. 13.

Another embodiment of a package 10' is illustrated in FIGS. 13 and 14; package 10' has a tamper-evident structure 100 positioned over and encasing resealable closure mechanism 30. Package 10' is similar to package 10 of FIGS. 1 and 2 in that package 10' has surrounding wall 13 formed by first and second panel sections 12, 14, joined at first and second side edges 22, 24 and at bottom edge 27. Resealable closure mechanism 30 extends from first side edge 22 to second side edge 24, and movement of slider device 50 is limited by first and second regions 16', 18'. Regions 16', 18' differ from regions 16, 18 of package 10 in that regions 16', 18' are displaced from side edges 22, 24; that is, regions 16', 18' are not continuous or contiguous with side edges 22, 24.

Package 10', however, has a tamper-evident structure 100 positioned over and encasing resealable closure mechanism 30 and slider device 50. Tamper-evident structure 100 is formed by extending sections 112, 114 of panel sections 12, 14, to which are sealed sealing flanges 36, 46 of closure mechanism 30 over closure mechanism 30 and slider device 50, as shown in FIG. 14. The extending sections 112, 114 are heat-sealed together at top edge 26. In order to access slider device 50, tamper-evident structure 100 must be penetrated, for example, at area of weakness 110. An example of an area of weakness 110 is a perforation line, score line, laser score, or tear strip. Area of weakness 110 extends parallel to resealable closure mechanism 30 for a portion of the distance between first side edge 22 and second side edge 24 and extends at an angle of about 90 degrees to resealable closure mechanism for another portion of the distance; area of weakness 110 extends parallel to side edges 22, 24 for a portion of area of weakness 110.

Figure 15:
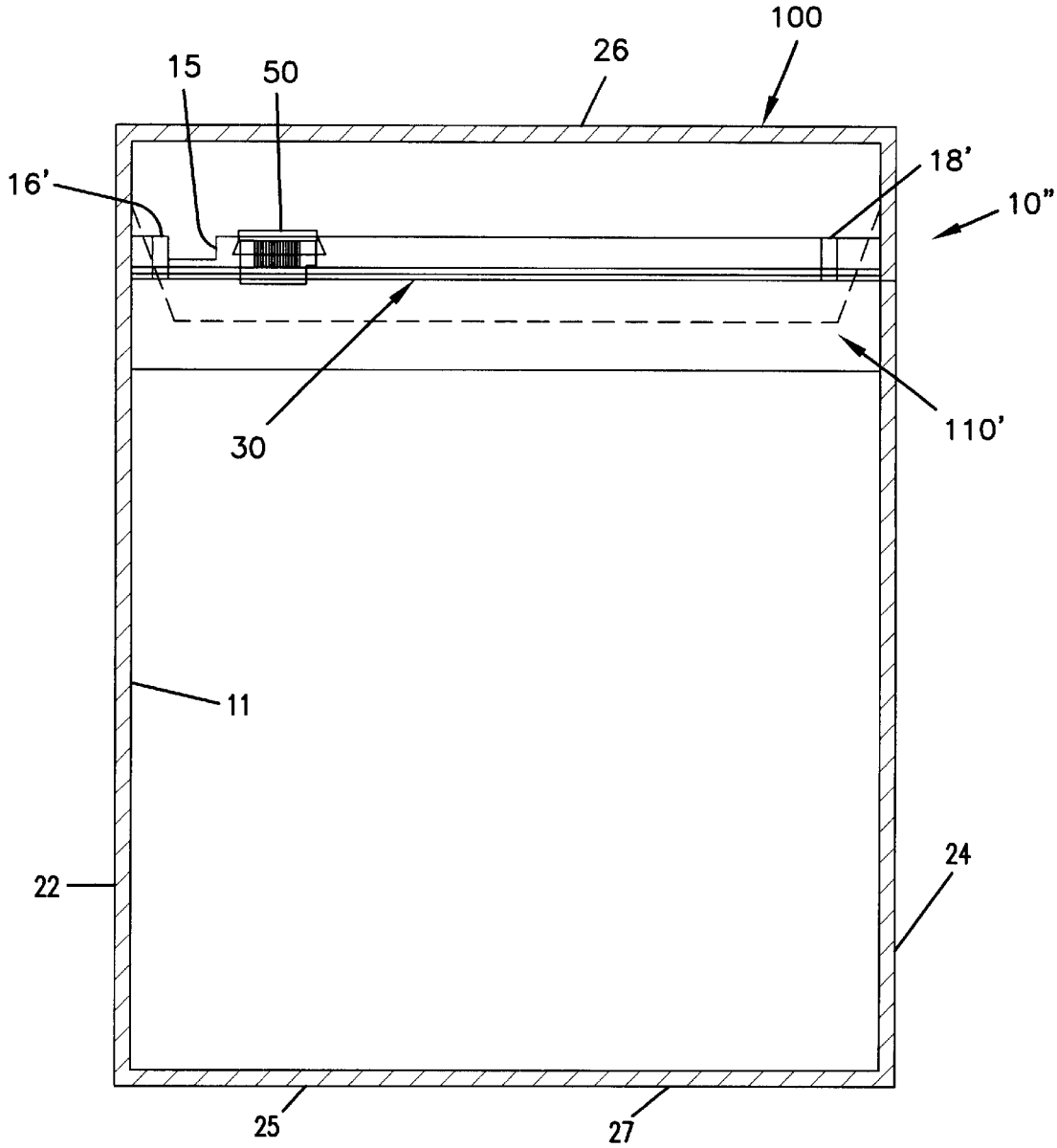
FIG. 15 is a schematic front plan view of a third embodiment of a reclosable package having the slider device shown in FIGS. 3 through 9.

Yet another embodiment of a package 10" is illustrated in FIG. 15; package 10" has a tamper-evident structure 100 positioned over and encasing resealable closure mechanism 30. Package 10" is similar to package 10 of FIGS. 1 and 2 and package 10' of FIGS. 13 and 14 in that package 10" has surrounding wall 13 formed by first and second panel sections 12, 14, joined at first and second side edges 22, 24 and at bottom edge 27. Resealable closure mechanism 30 extends from first side edge 22 to second side edge 24, and movement of slider device 50 is limited by first and second regions 16', 18' displaced from side edges 22, 24.

Package 10" has tamper-evident structure 100 positioned over and encasing resealable closure mechanism 30 and slider device 50. Package 10" differs from package 10' of FIGS. 13 and 14 in that tamper-evident structure 100 is penetrated at area of weakness 110'. An example of an area of weakness 110' is a perforation line, score line, laser score, or tear strip. Area of weakness 10' extends parallel to resealable closure mechanism 30 for a portion of the distance between first side edge 22 and second side edge 24 and extends at an angle other than 90 degrees to resealable closure mechanism for another portion of the distance; that is, area of weakness 110' is not parallel nor perpendicular to resealable closure mechanism for a portion of the length of resealable closure mechanism. Area of weakness 110' extends to and terminates at side edges 22, 24 rather than at top edge 26 as does area of weakness 110 of package 10'.

For additional details regarding packages having a tamper-evident structure, see for example, U.S. patent application having Ser. No. 09/706,250, filed Nov. 3, 2000, which claims priority to U.S. provisional patent application having serial No. 60/194,975, filed Apr. 5, 2000, both of which are incorporated herein by reference.

Referring again to FIGS. 1 and 2 and to FIGS. 13 and 14 and 15, the slider device 50 is provided to open and close the resealable closure mechanism 30. One preferred slider device 50 is illustrated in FIGS. 3 through 9. Although each of FIGS. 3 through 9 shows various features of slider device 50, attention is directed to FIGS. 3 and 4 where slider device 50 is shown in top and bottom perspective views. Slider device 50 preferably comprises a one-piece unitary, molded plastic member with no moveable parts that are moveable with respect to one another. In general, the slider device 50 includes a housing 52 for slidably engaging the closure mechanism 30. The housing 52 is movable between a closed position of the package 10 when the housing 52 is adjacent the first side edge 22 (FIG. 1) and an open position of package 10 when the housing 52 is adjacent the second side edge 24 (FIG. 1). FIG. 1 illustrates the resealable package 10 in an open position. The housing 52 slides over the resealable closure mechanism 30 relative to the top edge 26 of the resealable package 10 to open and close the mouth 20.

The housing 52 is preferably a multi-sided construction configured for engaging or locking onto or over the resealable closure mechanism 30. In the particular embodiment illustrated in FIGS. 3 and 4, the housing 52 includes a top wall 54. By the term "top", it is meant that in the orientation of the slider device 50 shown in FIGS. 1 and 2, the top wall 54 is oriented above the remaining portions of the housing 52. It should be understood, of course, that if the housing 52 were moved from the orientation shown in FIGS. 1 and 2, the top wall 54 would not be in a top orientation. Referring again to FIGS. 3 and 4, the top wall 54 defines a first end 55 and an opposite second end 56. The top wall 54 also defines an open aperture 58. The open aperture 58 divides the top wall 54 between a first portion 60 and a second portion 61. The first portion 60 generally comprises a flat, planar portion in extension from a periphery of the open aperture 58 to the edge defined by the first end 55. Similarly, the second portion 61 generally comprises a flat, planar portion in extension from a periphery of the open aperture 58 to the edge defined by the second end 56.

The housing 52 includes a separation structure for separating the first and second closure profiles 32, 42. That is, when the resealable closure mechanism 30 is in a closed state such that the mating closure members 35, 45 are interlocked, the separation structure will apply a force to wedge open and pull the closure members 35, 45 apart from each other. In the embodiment illustrated, the housing 52 includes a spreader 66 operating as a separation structure. The spreader 66, in the preferred embodiment shown, extends or depends from the top wall 54. Preferably, the spreader 66 comprises first and second angled wedges 68, 69 separated by a gap 70 (FIG. 5) therebetween.

Figure 5:
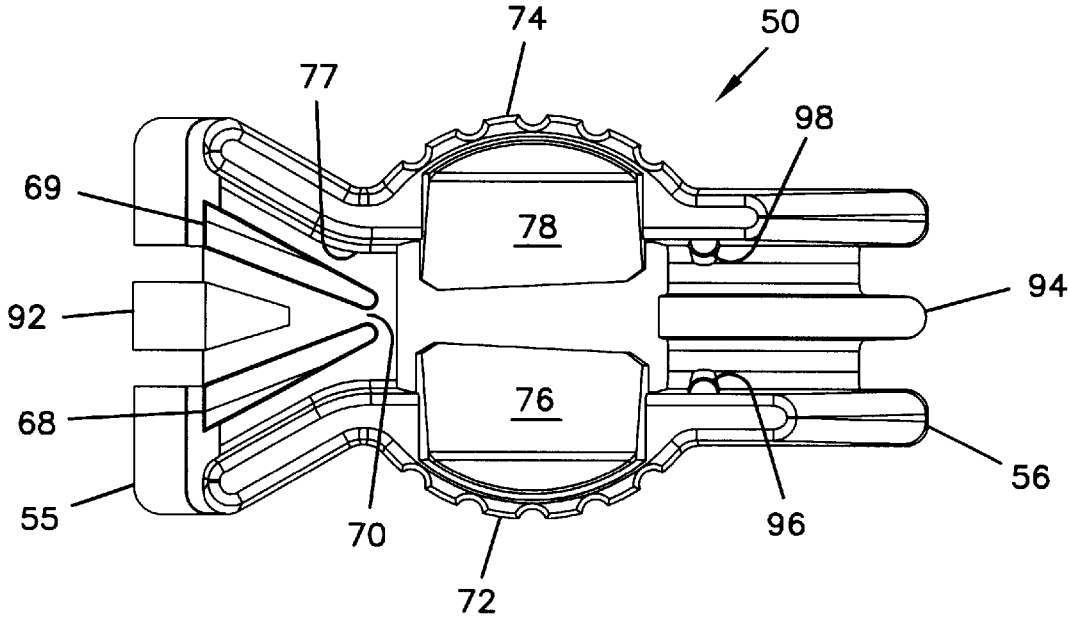
FIG. 5 is a bottom plan view of the slider device of FIGS. 3 and 4.

Attention is now directed to FIG. 5. In FIG. 5, it can be seen that the first and second wedges 68, 69 are angled toward each other, from the first end 55 of the slider device 50 to an opposite end of the wedges 68, 69, to form an overall triangle shaped spreader 66, in plan view, with an apex of the triangle pointing toward the second end 56 of the housing 52. The gap 70 between the first wedge 68 and second wedge 69 helps to contribute to convenient manufacturing techniques for the housing 52, such as injection molding. In another embodiment, first and second wedges 68, 69 are connected to each other at the apex of the triangle and a central groove, positioned where gap 70 is between wedges 68, 69 in FIG. 5, is positioned between the connected wedges. The two wedges may be tapered toward each other to form the central groove. In yet another embodiment, spreader 66 is a triangular structure that does not include individual wedges such as wedges 68, 69; rather, spreader 66 has a unitary construction.

Preferably, spreader 66 only extends partially in the resealable closure mechanism 20. More preferably, spreader 66 only extends between the upper flanges 38, 48 and does not penetrate the mating closure members 35, 45. This helps to reduce likelihood of leaks in the closure mechanism 30.

The preferred housing 52 shown also includes first and second sidewalls 72, 74. Preferably, each of the first and second sidewalls 72, 74 extends from and is cantilevered from the top wall 54 to form a slide channel 77 therebetween. In preferred embodiments, the first and second sidewalls 72, 74 are injection molded with the remaining parts of the housing 52. In other words, preferably the housing 52 comprises a single, unitary, integral piece of material with no additional materials welded, fastened, or bolted together. As can be viewed in FIGS. 3 and 4, the sidewalls 72, 74 can include a texture, such as ribs 73, 75, to help improve gripping and handling by the user. In FIGS. 3 through 6, note that the sidewalls 72, 74 diverge away from each other at the first end 55 in the first portion 60; form convex portions in a middle section; and are generally parallel in the second portion 61. These features also improve gripping and handling by the user.

Figure 4:
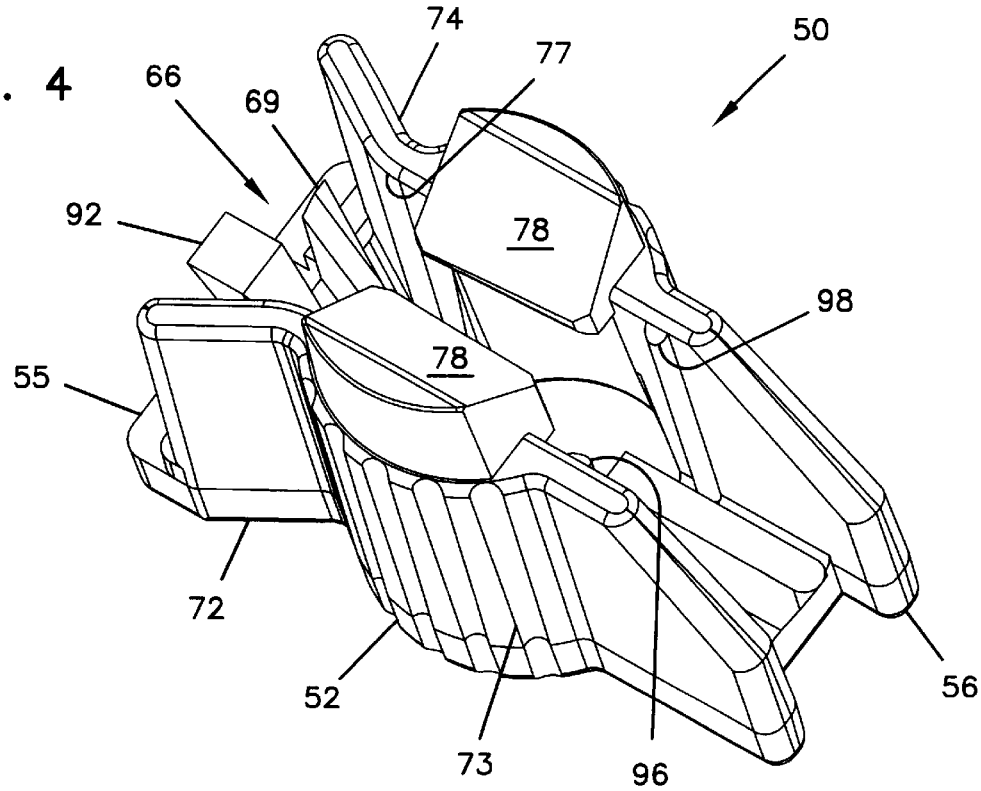
FIG. 4 is an enlarged, bottom perspective view of the slider device of FIG. 3.

Slider device 50 further includes first and second drag reducing standoffs 96, 98, shown in FIGS. 4 and 5. The first standoff 96 preferably projects or extends from the first sidewall 72 as a protrusion or pin or rod. Likewise, the second standoff 98 projects or extends from the second sidewall 74. Preferably, the first standoff 96 extends the entire length between the bottom of the first sidewall 72 and the top wall 54. Likewise, preferably the second standoff 98 extends the entire length between the top wall 54 and the bottom edge of the second sidewall 74.

In operation, the standoffs 96, 98 slidably communicate with the first and second closure profiles 32, 42, respectively. Because of the projection and extension of the standoffs 96, 98 relative to the remaining portions of the housing 52, the amount of surface area contact or material inducing friction between the housing 52 and the closure mechanism 30 is minimized. This permits easier manipulation of the slider device 50 by the user.

Preferably, the slider device 50 includes a system for permitting the housing 52 to slide along the resealable closure mechanism 30 without becoming disengaged from the resealable package 10. In the embodiment illustrated, the slider housing 52 engages or interlocks with a portion of the resealable closure mechanism 30; in particular, the housing 52 has a first and a second hook construction 76, 78, at least one of which is seen in each of FIGS. 3 through 5 and 7 through 9, which engage with the closure mechanism 30. The first hook construction 76 preferably extends from the first sidewall 72, and the second hook construction 78 preferably extends from the second side wall 74. When slider device 50 is mount on resealable closure mechanism, the closure mechanism 30 is positioned between first hook construction 76 and second hook construction 78.

Figure 9:
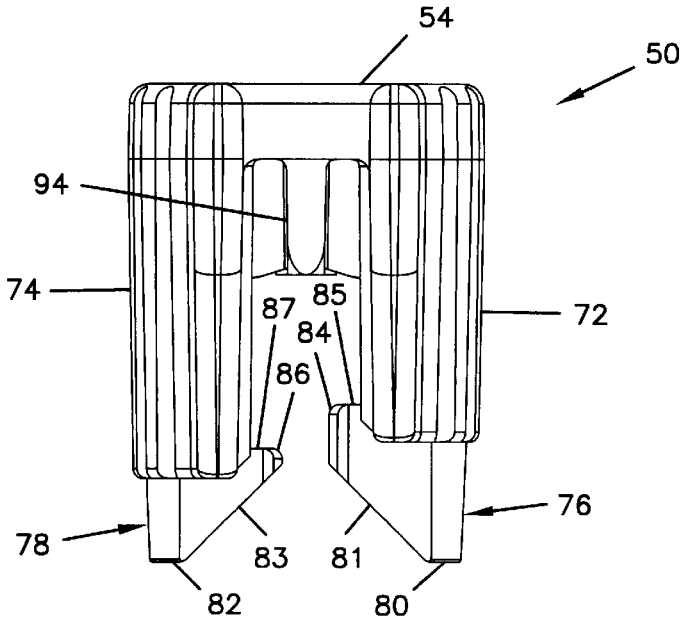
FIG. 9 is an end elevational view of the slider device of FIGS. 3 through 8.
Figure 7:
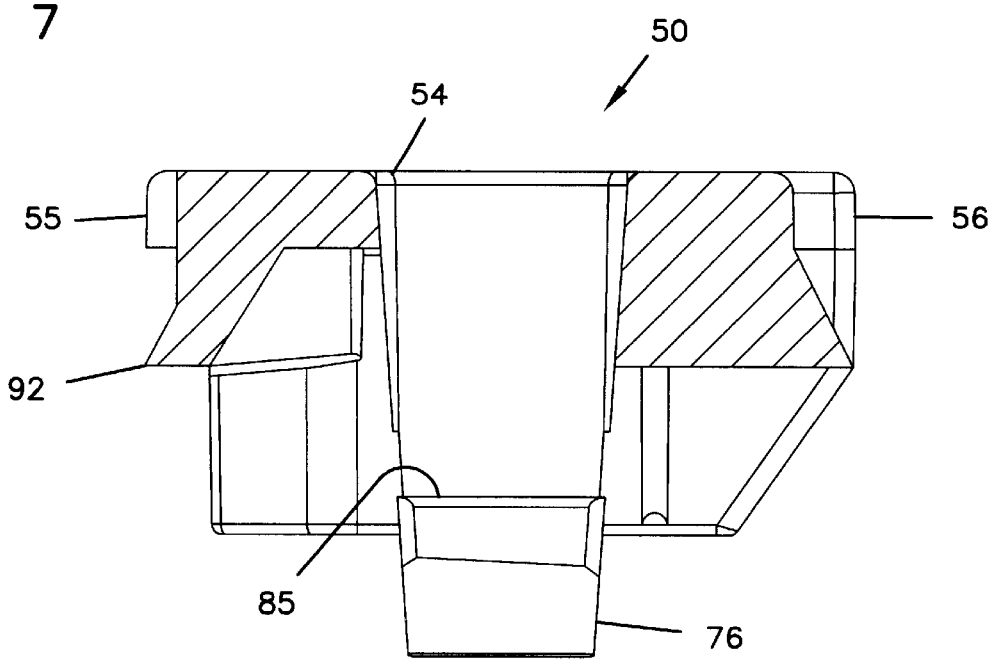
FIG. 7 is a cross-sectional view of the slider device of FIGS. 3 through 6 taken along the line 7—7 of FIG. 6.

As best seen in FIG. 9, the first hook construction 76 preferably includes a hook base 80 in lateral extension from the first sidewall 72. Extending or projecting from hook base 80 is a deflection surface 81. Deflection surface 81 is oriented toward the top wall 54 as a sloped or tapered surface. Deflection surface 81 terminates at tip 84; tip 84, in combination with first side wall 72, forms a hook or catch for slidable engagement with the shoulder 39 of the first closure profile 32, as seen in FIG. 2. Tip 84 and tip 86 should be spaced apart sufficiently to allow room for resealable closure construction 30 to be positioned therebetween.

Analogously, the second hook construction 78 preferably includes a hook base 82 in extension from the second sidewall 74 and in a region of the housing 52 below the open aperture 58. A deflection surface 83 projects or extends from hook base 82 in a direction oriented toward the top wall 54; deflection surface 83 is sloped, angled, or tapered toward top wall 54. Deflection surface 83 terminates at tip 86. As such, the tip 86 and second side wall 74 cooperate to form a hook or catch for engaging in a slidable manner with the shoulder 49 of the second closure profile 42, as seen in FIG. 2.

Deflection surfaces 81, 83 are configured to be at an angle other than being parallel to or perpendicular to either side walls 72, 74 and top wall 54. If an imaginary line were drawn extending each of first and second deflection surfaces 81, 83 up to top wall 54, such lines would be positioned so form an angle in relation to top wall 54. This angle between either extended imaginary line and top wall 54 is about 30 to 60 degrees, typically about 40 to 50 degrees, and preferably about 45 degrees. In other words, deflection surfaces 81, 83 form an angle of about 30 to 60 degrees, typically about 40 to 50 degrees, and preferably about 45 degrees to a plane parallel to top wall 54. The angle between the two imaginary lines is about 60 to 120 degrees, typically about 80 to 100 degrees, and preferably about 90 degrees.

Although shown as generally positioned perpendicular to top wall 54 and extending away with a generally even width, sidewalls 72, 74 can be positioned at an angle to top wall 54 other than perpendicular, or may taper down in thickness from top wall 54 to hook base 80, 82.

As can be seen in both FIG. 9 and also in FIG. 2, the first hook construction 76 is located closer to the top wall 54 than the second hook construction 78. This is generally because, in the embodiment shown, the second sidewall 74 is longer than the first sidewall 72. Additionally, first tip 84 is positioned closer to top wall 54 than second tip 86. In some embodiments, however, it may be preferred to have first sidewall 72 essentially the same length as second sidewall 74, thus providing tip 84 and engagement surface 85 essentially level with tip 86 and engagement surface 87. The structure of the hook constructions 76, 78 is generally dictated by the structure of the first and second closure profiles 32, 42.

Referring again to FIG. 9, it can be seen that sidewalls 72, 74 extend from top wall 54. The transition area between the sidewalls 72, 74 and top wall 54 can be rounded or radiused, as shown in FIG. 9, of the transition area may be a sharp point, such as a 90 degree angle between the sidewalls 72, 74 and top wall 54. A sharp transition point provides a high degree of flexibility between the top wall 54 and sidewalls 72, 74; a sharp transition point acts as a hinge or cantilever point.

Figure 3:
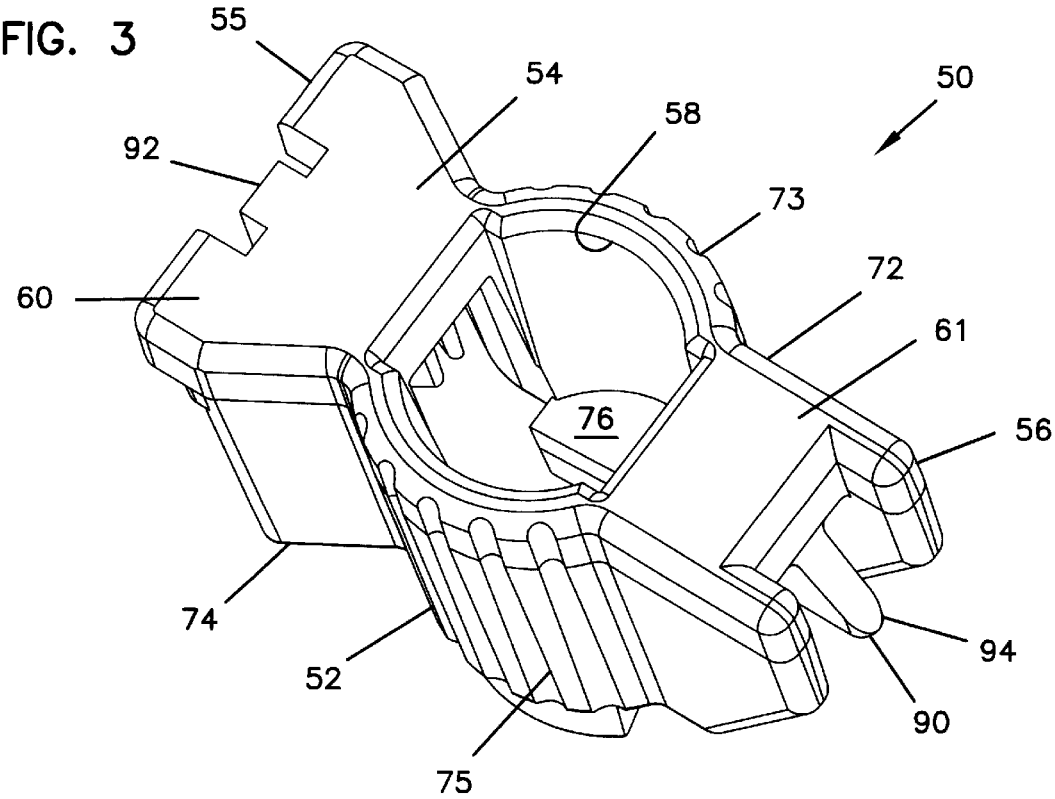
FIG. 3 is an enlarged, top perspective view of the slider device of FIG. 1, according to principles of this disclosure.

The slider device 50 preferably includes a system for guiding the slider device 50 between the side edges 22, 24 (FIG. 1) and for preventing the slider device 50 from sliding off the edge of the package 10 (FIG. 1). In the embodiment illustrated, the system includes a guide construction 90 (FIG. 3). The guide construction 90 detects regions 16, 18 before any other structure on the housing 52 engages the side edges 22, 24 of the package 10. Preferably, the guide construction 90 depends from the top wall 54, but could depend from other portions of the housing 52 in other embodiments.

Figure 6:
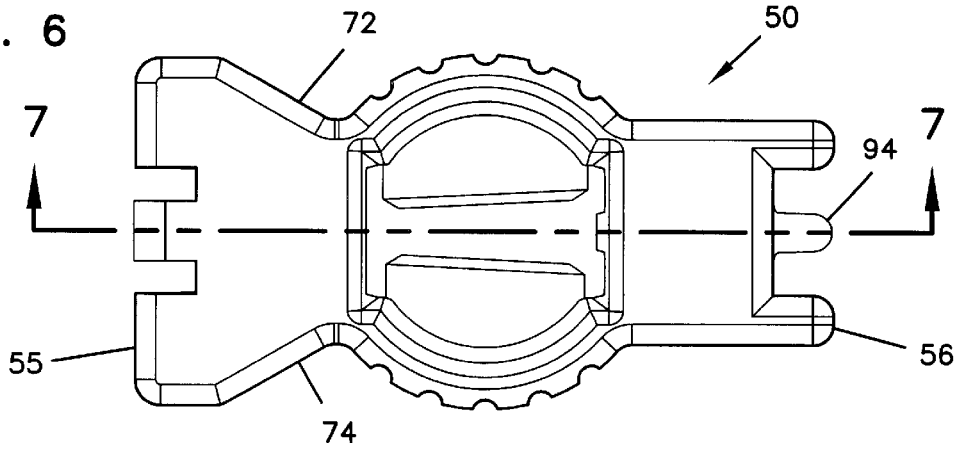
FIG. 6 is a top plan view of the slider device of FIGS. 3, 4 and 5.
Figure 8:
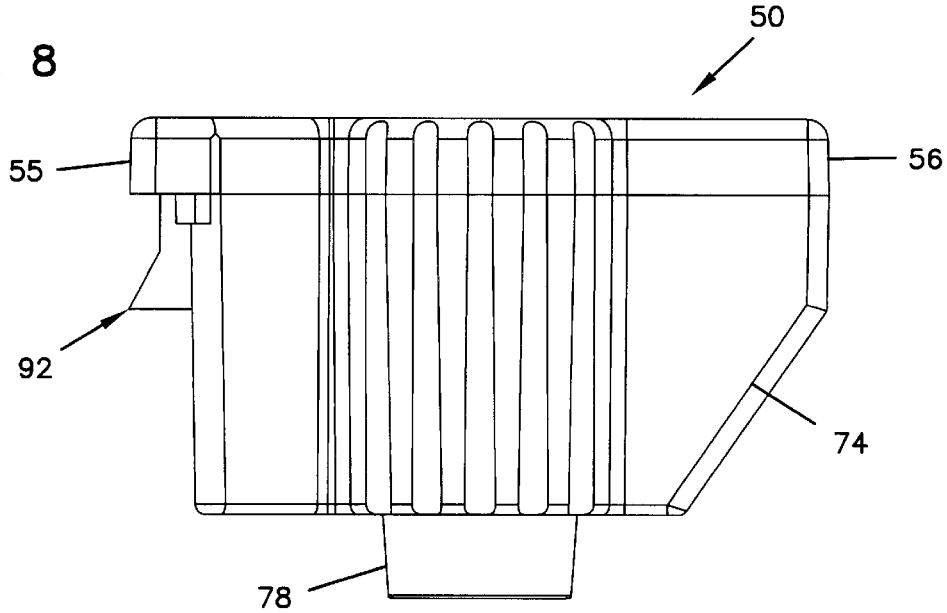
FIG. 8 is a side elevational view of the slider device of FIGS. 3 through 7.

While a variety of structures are contemplated, in the particular embodiment illustrated in the drawings, the guide construction 90 has first and second bumpers or elongate fingers or noses 92, 94 (FIGS. 3 and 5). In operation, the first finger or nose 92 at first end 55 will abut or engage the region 16 to inhibit the housing 52 from sliding off of the resealable package 10. First finger or nose 92 is defined by recesses in housing 52 at first end 55, as seen in FIGS. 3 and 5 through 8. Analogously, the second finger or nose 94 at second end 56 will abut or engage the region 18 to inhibit the housing 52 from sliding off of the resealable package 10. Second finger or nose 94 is defined by recesses in housing 52 at second end 56, as seen in FIGS. 3, 5 and 6. Thus, the guide construction 90 helps to keep the housing 52 within the boundaries or periphery defined by the side edges 20 and 22. Although first finger or nose 92 is illustrated as having a fairly square or rectangular shape and second finger or nose 94 is illustrate as having a rounded shape, fingers or noses 92, 94 can have any shape, such as square, rectangular, rounded, triangular (pointed), truncated point, and the like.

As indicated previously, one preferred technique for manufacturing the slider housing 52 is by injection molding a plastic material such as polypropylene. While other methods are possible, injection molding is convenient and preferred, and it is understood that materials other than polypropylene can be used. In addition, injection molding allows for ornamental features to be molded as part of the housing 52.

To construct the flexible resealable package 10 having a slider device 50, the package 10 can be formed by either a blown extrusion process or by using a pre-formed roll of film. Various manufacturing techniques can be used to provide package 10 from preformed film. In one embodiment, the film is folded at fold line 25 and first and second panel sections 12, 14 are heat-sealed together along two side edges 22, 24 in order to form the package 10. In package 10 of FIG. 1, the fold line 25 comprises the bottom edge 27 of the package 10. In another embodiment, first and second panel sections 12, 14 are provided by folding a film at one of side edges 22, 24 and heat-sealed at the other side edge and at bottom edge 27. In a further embodiment, the film can be folded at both side edges 22, 24 and joined at a fin seal (not shown) within one of panel sections 12, 14. In a variation of this embodiment, a tube of film can be used. The tube forms side edges 22, 24 and a seal is made at bottom edge 27. In yet another embodiment, two separate film pieces form panel sections 12, 14 which are heat-sealed together along the two side edges 22, 24 and at the bottom edge 27. In all of these embodiments, a fourth side is left unsealed; this side provides mouth 20. As mentioned above, in some embodiments it may be desired to delay the sealing at bottom edge 27 in order to allow filling of the package 10 through bottom edge 27.

The resealable closure mechanism 30 can be applied to the film panel sections 12, 14 by heat sealing the sealing flanges 36, 46 of closure profiles 32, 42 to the panel sections 12, 14. The notch 15 can be cut into the upper flanges or distal ends 38, 48 of the closure profiles 32, 42. Next, the side seals including the regions 16, 18 can be formed, such as by ultrasonic crushing. The housing 52 can then be mounted over the resealable closure mechanism 30 by sliding it over distal ends 38, 48. It is understood that the process of forming the package, including making regions 16, 18, notch 15, and the like, can be done in any sequence of steps; in some embodiments, multiple steps can be done simultaneously. Additionally, in some embodiments it may be desired to have the package filled with items prior to mounting slider device 50.

During the mounting of slider device 50, distal ends 38, 48 of closure profiles 32, 42 are urged by deflection surfaces 81, 83 of hook constructions 76, 78 into slide channel 77. The tapered or sloped surfaces of deflection surfaces 81, 83 facilitate positioning distal ends 38, 48 and closure profiles 32, 42 into slide channel 77. The sloped deflection surfaces 81, 83 properly orient the housing 52 during the mounting process if slider device 50 is misaligned prior to being mounted. It is understood that the slider device 50 can be mounted onto the closure mechanism 30 after the closure mechanism 30 is incorporated into a package 10, as described above, or the slider device 50 can be mounted on the closure mechanism 30 before the closure mechanism 30 is incorporated into a package. Slider device 50 can be mounted onto mated or unmated closure profiles 32, 42.

Various techniques for mounting slider device 50 onto closure mechanism 30 are available. Example methods are taught in U.S. patent applications Ser. Nos. 09/611,167, 09/611,174, and 09/611,236 all filed Jul. 6, 2000; U.S. patent application Ser. No. 09/363,626 filed Jul. 29, 1999; and U.S. patent application Ser. No. 09/351,830 filed Jul. 12, 1999, each of which is incorporated herein by reference. The slider device 50 can be mounted by a horizontal, vertical, angled, or any other mounting or application process. The mounting of slider device 50, whether accomplished by these example techniques or others, can be accomplished mechanically, pneumatically, or manually. In some mounting processes, the hook constructions 76, 78 may be at least partially deflected prior to contacting closure mechanism 30.

As described above, the housing 52 is pressed onto the resealable closure mechanism 30 over the distal ends 38, 48 (FIG. 2) so that distal ends 38, 48 abut deflections surfaces 81, 83. As the distal ends 38, 48 are forced against surfaces 81, 83, the first and second hook constructions 76, 78 deform or deflect outwardly until the tips 84, 86 of first and second hook constructions 76, 78 snap over the shoulders 39, 49 of the closure profiles 32, 42 and the slider device 50 is mounted on closure mechanism 30. The hook constructions 76, 78 are preferably sufficiently flexible to facilitate mounting of the slider device 50, yet sufficiently stiff to retain the slider device 50 onto the resealable closure mechanism 30. The amount of flex in hook constructions 76, 78 needs to be balanced to accomplish these two goals.

In some embodiments, it is desired to mount housing 52 into or onto the notch 15 (FIG. 1), if present. The notch 15 can be any length; in some embodiments, the notch 15 has a minimal length that can be best described as a slit. In other embodiments, notch 15 is twice as long as the length of the spreader 66. A length twice as long as spreader 66 is preferred, because when the slider housing 52 in moved into the closed position at notch 15, the widest part of the spreader 66 will be situated in the open area represented by the notch 15. As a result, the spreader 66 will not spread the walls of the closure mechanism 30 at this location. This ensures that when the slider housing 52 is moved all the way to the closed position, the closure mechanism 30 will be completely closed and, even in the part of the closure mechanism 30 located under the spreader 66, will not be spread or biased open. In other embodiments, it is desired to mount slider device 50 on closure mechanism 30 closer to one of side edge 22 or 24 rather than at notch 15. For example, slider device 50 can be mounted between first side edge 22 and notch 15, or between second side edge 24 and notch 15. In either embodiment, after slider device 50 has been mounted on the closure mechanism 30, slider device 50 can be moved into position at notch 15, for example, by guide fingers or bars that push the slider device 50 as the package moves.

To operate the mounted slider device 50, the slider device 50 is slid relative to the resealable closure mechanism 30 from the closed position at first side edge 22 to the open position at second side edge 24. As the housing 52 is moved from the closed position to the open position, the spreader 66 forces the mated closure members 35, 45 apart from each other. The spreader 66 is spaced between the upper flanges or distal ends 38, 48 of the profile members 32, 42 and opens the mouth 20 as the slider housing 52 is moved along the resealable closure mechanism 30 of package 10 in the direction toward where the triangle of spreader 66 "points." The opening happens because the triangular shape of the spreader 66 operates as a cam to force the closure profiles 32, 42 apart, and thus to disengage the interlocking closure members 35, 45. To close the resealable closure mechanism 30, the slider housing 52 is moved relative to the resealable closure mechanism 30 from the open position to the closed position. The closing happens because the slide channel 77 between the sidewalls 72, 74 is narrower at second end 56 (the end away or remote from the spreader 66) and is wider at the first end 55 (the end near or adjacent to the spreader 66). The spreader 66 does not depend very far downwardly into the closure mechanism 30, and it never actually passes between the interlocking closure members 35, 45, thus helping prevent leaks in the closure mechanism 30 when the slider device 50 is in the closed position. Note that no extra tools are needed for operation.

Figure 10:
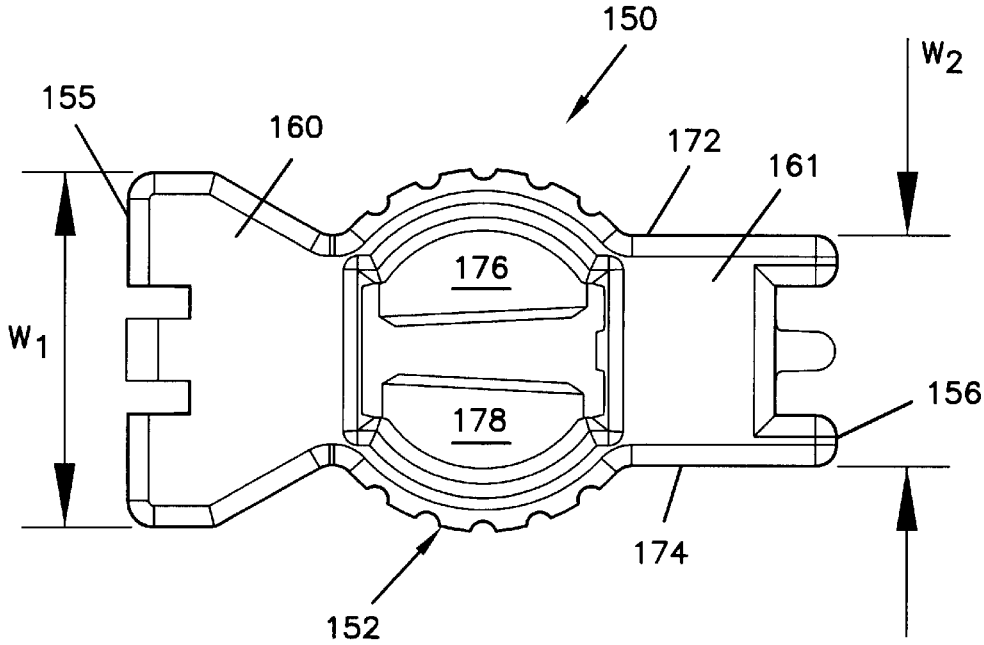
FIG. 10 is a top plan view of a slider device similar to that of FIG. 6, except that dimensions are included in FIG. 10.
Figure 11:
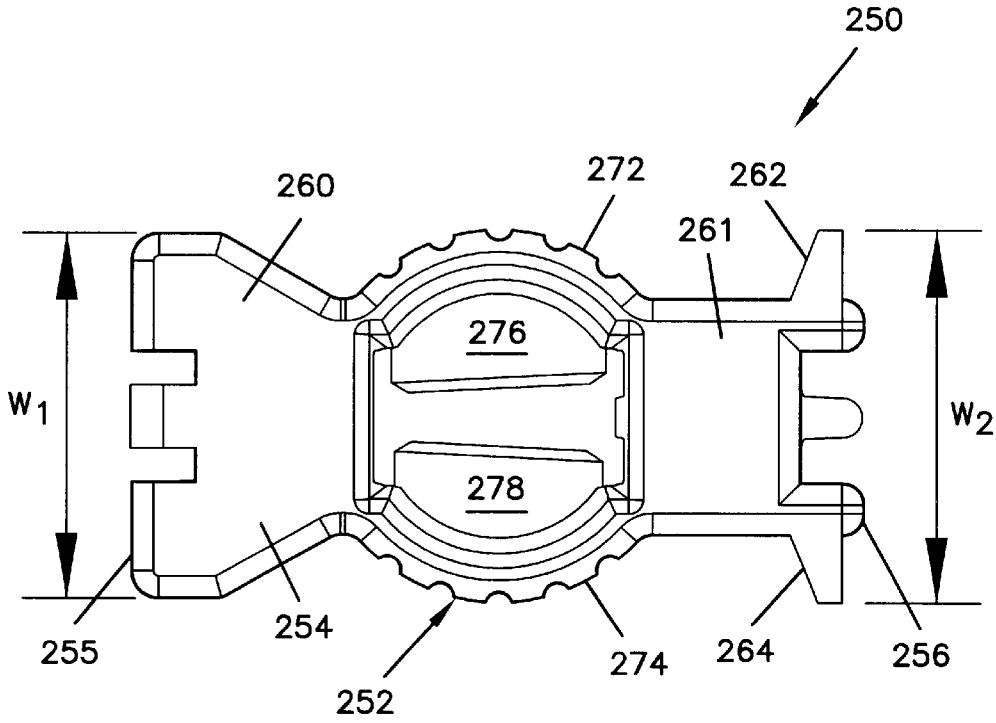
FIG. 11 is a top plan view, similar to the view of FIG. 10, of a second embodiment of a slider device, according to principles of this disclosure.
Figure 12:
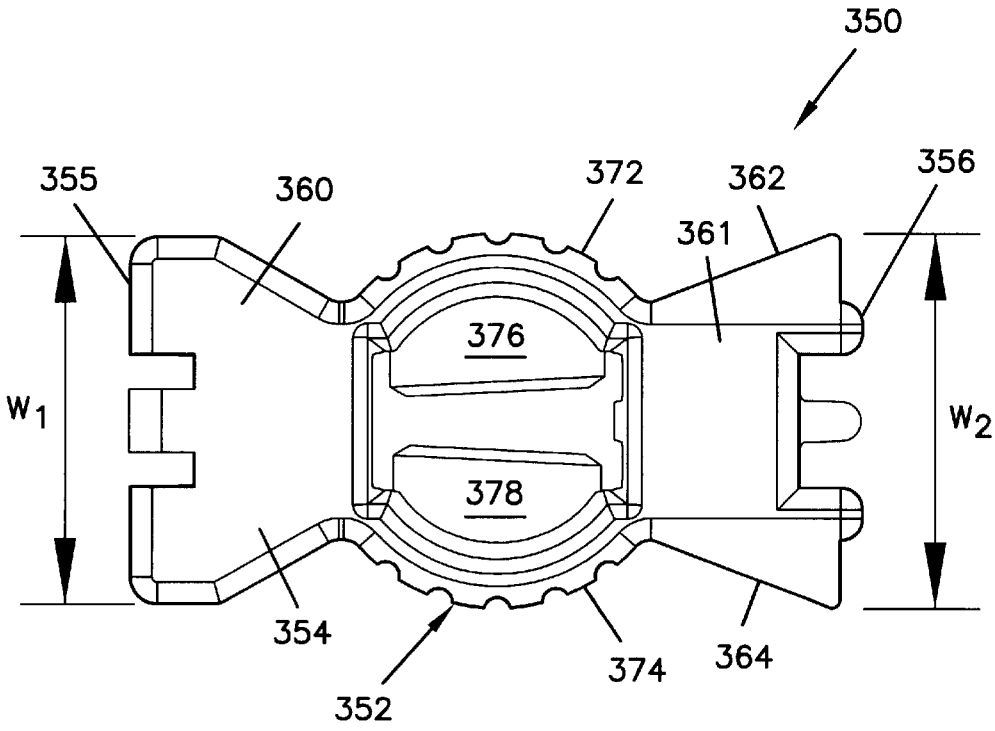
FIG. 12 is a top plan view, similar to the view of FIGS. 10 and 11, of a third embodiment of a slider device, according to principles of this disclosure.

FIGS. 10, 11 and 12 show various alternative embodiments of slider device 50. Slider device 150 of FIG. 10 is essentially the same as slider device 50 of FIGS. 3 through 9. Slider device 150 has housing 152 defined by first and second sidewalls 172, 174 and includes first portion 160 and second portion 161. Sidewalls 172, 174 form hook constructions 176, 178. Slider device 150 at first end 155 has a width of W1; at second end 156, slider device 150 has a width of W2. Each of width W1 and W2 are defined by the distance between first sidewall 172 and second sidewall 174. In the embodiment shown, W1 is greater than W2; that is, first end 155 is wider than second end 156.

In alternate embodiments, W1 and W2 can be the same width; this may be done, for example, to facilitate mounting and orienting the slider device onto the closure mechanism 30. FIGS. 11 and 12 show alternate embodiments of slider device 50, 150.

In FIG. 11, slider device 250 has housing 252 defined by first and second sidewalls 272, 274 that form hook constructions 276, 278. Housing 252 further has first and second portions 260, 261 at first and second ends 255, 256, respectively. Second portion 261 includes projecting tabs 262, 264 which extend from second portion 261. Slider device 250 has a width W1 at first end 255 and a width W2 at second end 256. Width W1 is defined by the distance between first sidewall 272 and second sidewall 274, and width W2 is defined by tabs 262, 264. In slider device 250, W1 is essentially the same as W2. The equal end widths facilitate aligning and mounting of slider device 250 onto closure mechanism 30, and may improve handling of the slider device 50 as the slider device 50 is moved along closure mechanism 30.

In FIG. 12, slider device 350 has housing 352 defined by first and second sidewalls 372, 374 that form hook constructions 376, 378. Housing 352 further has first and second portions 360, 361 at first and second ends 355, 356, respectively. Second portion 361 includes angled wings 362, 364 which extend from second portion 361. Slider device 350 has a width W1 at first end 355 and a width W2 at second end 356. Width W1 is defined by the distance between first sidewall 372 and second sidewall 374, and width W2 is defined by wings 362, 364. For slider device 350, W1 is essentially the same as W2.

Tabs 262, 264 and wings 362, 364 may extend from the top wall 254, 354, respectively, to the bottom edge of slider device 250, 350, but preferably, tabs 262, 264 and wings 362, 364 do not extend to the bottom edge as a continuous feature. In one embodiment, tabs 262, 264 and wings 362, 364 are tapered as they approach the bottom edge. In another embodiment, tabs 262, 264 and wings 362, 364 can be segmented into multiple structures along the length from the top wall 254, 354 to the bottom edge. The elimination of tabs 262, 264 and wings 362, 364 extending continuously the entire height of slider device 250, 350 minimizes the amount of material needed to manufacture the slider device, and increases the outward flexibility of the housing 252, 352.

AN EXAMPLE EMBODIMENT

It will be understood that a wide variety of specific configurations and applications are feasible, using techniques described herein. In this section, a particular slider device is described.

The slider housing 52 has an overall length from the first end 55 to the second end 56 of at least about 0.5 inch (about 13 mm), no greater than about 2 inches (about 51 mm), typically about 0.65–0.75 inch (about 16–19 mm), and in a preferred embodiment about 0.693 inch (about 18 mm).

At the first end 55, the width of the slider housing 52, as defined by the distance between the outer part of the sidewalls 72, 74, is at least about 0.1 inch (about 3 mm), no greater than about 0.6 inch (about 15.2 mm), typically about 0.2–0.4 inch (about 5.1–10.2 mm), and in preferred embodiments about 0.3–0.4 inch (about 7.6–10.2 mm). A particular preferred embodiment is about 0.346 inch (about 8.8 mm).

At the second end 56, the width of the slider housing 52, as defined by the distance between the outer part of the sidewalls 72, 74, is at least about 0.1 inch (about 3 mm), no greater than about 0.5 inch (about 13 mm), typically about 0.2–0.25 inch (about 5.1–6.4 mm), and in preferred embodiments about 0.23–0.24 inch (about 5.8–6.1 mm). A particular preferred embodiment is about 0.225 inch (about 5.7 mm).

The width of housing 52, between first end 55 and second end 56, as defined by the distance between the outer part of the sidewalls 72, 74, is at least about 0.1 inch (about 3 mm), no greater than about 0.7 inch (about 17.8 mm), typically about 0.2–0.5 inch (about 5.1–12.7 mm), and in preferred embodiments about 0.3–0.4 inch (about 7.6–10.2 mm). A particular preferred embodiment is about 0.353 inch (about 9 mm).

The thickness of top wall 54 is at least 0.05 inch (about 1.3 mm), no greater than about 0.1 inch (about 2.5 mm), and is typically about 0.06 to 0.09 inch (about 1.5–2.3 mm). In a preferred embodiment, the thickness of top wall 54 is about 0.075 inch (about 1.9 mm).

The height of housing 52, that is, from top wall 54 to either hook base 80 or hook base 82 is at least about 0.3 inch (about 7.6 mm), no greater than about 1 inch (about 25 mm), typically about 0.35–0.5 inch (about 8.9–12.7 mm), and in preferred embodiments about 0.475 inch (about 12 mm).

The length of the second sidewall 74, that is, from top wall 54 to engagement surface 87 is at least about 0.2 inch (about 5 mm), no greater than about 1 inch (about 25 mm), typically about 0.275–0.45 inch (about 7–11.4 mm), and in preferred embodiments about 0.3 to 0.4 inch (about 7.6–10.2 mm). A particular distance is about 0.362 inch (about 9.2 mm). The length of the first sidewall 72, from top wall 54 to engagement surface 85, is at least about 50 percent of the length of the sidewall 74, no greater than about 100 percent, and typically about 85–95 percent. This would be typically about 0.23 to 0.43 inch (about 5.9–10.9 mm), and in preferred embodiments about 0.25 to 0.38 inch (about 6.5–9.6 mm). A particular preferred distance is about 0.318 inch (about 8.1 mm).

The finger 92 is generally flush with first end 55, and finger 94 is generally flush with second end 56. In some embodiments, either one or both of fingers 92, 94 may extend from end 55, 56, respectively, at least about 0.02 inch (about 0.5 mm), no greater than about 0.25 inch (about 6 mm), typically about 0.035–0.045 inch (about 0.9–1.1 mm).

Each of the fingers 92, 94 has a width of at least about 0.02 inch (about 0.5 mm), no greater than about 0.2 inch (about 5 mm), typically about 0.04–0.07 inch (about 1–1.8 mm), and in preferred embodiments about 0.05–0.06 inch (about 1.3–1.5 mm).

Each wedge 68, 69 is spaced from its respective sidewall 72, 74 by a distance of at least about 0.01 inch (about 0.3 mm), no greater than about 0.1 inch (about 3 mm), typically about 0.020–0.035 inch (about 0.5–0.9 mm), and in preferred embodiments about 0.022–0.029 inch (about 0.6–0.7 mm).

The spreader 66 has a length at the base of its triangle portion of at least about 0.05 inch (about 1.3 mm), no greater than about 0.25 inch (about 6.4 mm), typically about 0.11–0.150 inch (about 2.8–3.8 mm), and in preferred embodiments about 0.12–0.14 inch (about 3.0–3.6 mm).

The depth of the spreader 66 from the top wall 54 is at least about 0.05 inch (about 1.3 mm), no greater than about 0.5 inch (about 13 mm), typically about 0.11–0.2 inch (about 2.8–5.1 mm), and in preferred embodiments about 0.11–0.13 inch (about 2.8–3.3 mm).

The first and second standoffs 96, 98 project at least about 0.0085 inch (about 0.22 mm) from their respective sidewalls 72, 74, typically at least about 0.01 inch (about 0.25 mm).

The above specification and examples are believed to provide a complete description of the manufacture and use of particular embodiments of the invention. Many embodiments of the invention can be made without departing from the spirit and scope of the invention.

I claim:

1. A flexible package comprising:

(a) a package surrounding wall having first and second panel sections and a mouth therebetween; said mouth providing access to a package interior;

(b) a resealable closure mechanism along said mouth for selective opening and closing of said mouth; said closure mechanism extending from a first side edge to a second side edge and including first and second closure profiles;

(i) said first and second closure profiles being constructed and arranged to interlock; and (c) a slider device for selectively opening and closing said closure mechanism; said slider device having a housing defined by a first sidewall and a second sidewall each having a first end and a second end, the slider device further having:

(i) a top wall;

(ii) a spreader depending from said top wall for separating said first and second closure profiles;

(iii) a first hook construction depending from said top wall, said first hook construction having:

(A) a first end opposite said top wall, the first end defining a hook length;

(B) a first deflection surface positioned on an internal surface of said first hook construction at said first end and positioned at an angle of about 40 to 50 degrees from said top wall; and (C) a first engagement surface to engage said first closure profile, the first engagement surface extending the hook length;

(iv) a second hook construction depending from said top wall, said second hook construction having:

(A) a second end opposite said top wall, the second end defining a hook length;

(B) a second deflection surface positioned on an interior surface of said second hook construction at said first end and positioned at an angle of about 40 to 50 degrees from said top wall; and (C) a second engagement surface to engage said second closure profile, the second engagement surface extending the hook length; and (v) a channel defined by said first and second hook constructions and extending therebetween to accept said closure mechanism.

2. A flexible package according to claim 1, wherein:

(a) said first hook construction comprises:

(i) a first hook base defined by said first end;

(ii) said first hook base extending from said first sidewall to said first engagement surface;

(iii) said first engagement surface and said first deflection surface joined at a first tip; and (b) said second hook construction comprises:

(i) a second hook base defined by said second end;

(ii) said second hook base extending from said second sidewall to said second engagement surface;

(iii) said second engagement surface and said second deflection surface joined at a second tip.

3. A flexible package according to claim 2, wherein said first deflection surface and said second deflection surface have an angle therebetween of about 80 to 100 degrees.

4. A flexible package according to claim 3, wherein said first deflection surface and said second deflection surface have an angle therebetween of about 90 degrees.

5. A flexible package according to claim 2, wherein said slider device further comprises:

(a) a guide construction extending past at least one of said first and second ends of said first sidewall in a direction away from remaining portions of said slider device and toward one of said first and second side edges;

(i) said guide construction being constructed and arranged to abut at least one of said first and second side seals, when the slider device is selectively moved along the mouth adjacent to one of the first and second seals.

6. A flexible package according to claim 2, said slider device having:

(a) a first width at said first end; and (b) a second width at said second end, said first width being essentially equal to said second width.

7. A flexible package according to claim 2, wherein:

(a) said first closure profile defines a first shoulder;

(b) said first engagement surface engages said first shoulder;

(c) said second closure profile defines a second shoulder; and (d) said second engagement surface engages said second shoulder.

8. A flexible package according to claim 7, wherein each of said first and second upper flanges defines a notch adjacent to said first side edge.

9. A flexible package according to claim 1, further comprising a tamper-evident structure encasing said slider device and said resealable closure mechanism.

10. A flexible package according to claim 9, said tamper-evident structure having an area of weakness.

11. A flexible package according to claim 10, wherein said area of weakness:

(a) extends essentially parallel to said resealable closure mechanism for a first portion of said resealable closure mechanism; and (b) extends to each of said first side edge and said second side edge at an angle other than perpendicular to said resealable closure mechanism.

12. A flexible package comprising:

(a) a package surrounding wall having first and second panel sections and a mouth therebetween; said mouth providing access to a package interior;

(b) a resealable closure mechanism along said mouth for selective opening and closing of said mouth; said closure mechanism extending from a first side edge to a second side edge and including first and second closure profiles;

(i) said first and second closure profiles being constructed and arranged to interlock; and (c) a slider device for selectively opening and closing said closure mechanism; said slider device having a housing defined by a first sidewall and a second sidewall each having a first end and a second end, the slider device further having:

(i) a top wall;

(ii) a spreader depending from said top wall for separating said first and second closure profiles;

(iii) a first hook construction defined by said first end and depending from said top wall, said first hook construction having:

(A) a first end opposite said top wall;

(B) a first deflection surface positioned on an internal surface of said first hook construction at said first end and positioned at an angle of about 40 to 50 degrees from said top wall;

(C) a first engagement surface to engage said first closure profile;

(D) a first hook base extending from said first sidewall to said first engagement surface;

(E) said first engagement surface and said first deflection surface joined at a first tip;

(iv) a second hook construction depending from said top wall, said second hook construction having:

(A) a second end opposite said top wall;

(B) a second deflection surface positioned on an interior surface of said second hook construction at said first end and positioned at an angle of about 40 to 50 degrees from said top wall; and (C) a second engagement surface to engage said second closure profile;

(D) a second hook base defined by said second end, said second hook base extending from said second sidewall to said second engagement surface;

(E) said second engagement surface and said second deflection surface joined at a second tip;

(v) a channel defined by said first and second hook constructions and extending therebetween to accept said closure mechanism; and (vi) a guide construction extending past at least one of said first and second ends of said first sidewall in a direction away from remaining portions of said slider device and toward one of said first and second side edges;

(A) said guide construction being constructed and arranged to abut at least one of said first and second side seals, when the slider device is selectively moved along the mouth adjacent to one of the first and second seals; and (B) said guide construction including first and second fingers depending from said top wall; and said first finger projecting beyond said first end.

13. A flexible package according to claim 12, wherein said first deflection surface and said second deflection surface have an angle therebetween of about 80 to 100 degrees.

14. A flexible package according to claim 13, wherein said first deflection surface and said second deflection surface have an angle therebetween of about 90 degrees.

15. A flexible package according to claim 12, further comprising a tamper-evident structure encasing said slider device and said resealable closure mechanism.

16. A slider device for use with a resealable closure mechanism having interlocking closure members, the slider device having a housing having a first end and a second end, the slider device comprising:

(a) a top wall;

(b) a spreader depending from and being integral with said top wall; said spreader for separating interlocked closure members, when the slider device is operably mounted on the resealable closure mechanism having interlocking closure members;

(c) a first sidewall extending from said top wall and defining a first hook construction at an end opposite said top wall, said first hook construction having a hook length; said first hook construction comprising:

(i) a first deflection surface positioned on an internal surface of said first hook construction and extending said hook length;

(ii) said first deflection surface forming an angle of about 40 to 50 degrees to a plane parallel to said top wall;

(iii) said first hook construction further comprising a first engagement surface, said first engagement surface and said first deflection surface joining at a first tip;

(d) a second sidewall extending from said top wall and defining a second hook construction at an end opposite said top wall, said second hook construction having a hook length; said second hook construction comprising;

(i) a second deflection surface positioned on an internal surface of said second hook construction and extending said hook length;

(ii) said second deflection surface forming an angle of about 40 to 50 degrees to a plane parallel to said top wall;

(iii) said second hook construction further comprising a second engagement surface, said second engagement surface and said second deflection surface joining at a second tip;

(iv) said first and second hook constructions for operably mounting and locking said slider device onto the resealable closure mechanism; and (e) a channel defined by said first and second hook constructions between said first tip and said second tip.

17. A slider device according to claim 16, wherein:

(a) said first hook construction further comprises:

(i) a first hook base extending from said first sidewall to said first engagement surface; and (b) said second hook construction comprises:

(i) a second hook base extending from said second sidewall to said second engagement surface.

18. A slider device according to claim 17, wherein a line extending from said first deflection surface and a line extending from said second deflection surface have an angle therebetween of about 80 to 100 degrees.

19. A slider device according to claim 18, wherein the line from said first deflection surface and the line from said second deflection surface have an angle therebetween of about 90 degrees.

20. A slider device according to claim 16, wherein:

(a) said first and second sidewalls define a slide channel therebetween for receipt of interlocking closure members, when the slider device is operably mounted on the resealable closure mechanism with interlocking closure members.

21. A slider device according to claim 16, further comprising a guide construction depending from said top wall.

22. A slider device for use with a resealable closure mechanism having interlocking closure members, the slider device having a housing having a first end and a second end, the slider device comprising:

(a) a top wall;

(b) a spreader depending from and being integral with said top wall; said spreader for separating interlocked closure members, when the slider device is operably mounted on the resealable closure mechanism having interlocking closure members;

(c) a first sidewall extending from said top wall and defining a first hook construction at an end opposite said top wall; said first hook construction comprising:
  (i) a first deflection surface positioned on an internal surface of said first hook construction;
  (ii) said first deflection surface forming an angle of about 40 to 50 degrees to a plane parallel to said top wall;
  (iii) said first hook construction further comprising a first engagement surface, said first engagement surface and said first deflection surface joining at a first tip;

(d) a second sidewall extending from said top wall and defining a second hook construction at an end opposite said top wall, said second hook construction comprising;
  (i) a second deflection surface positioned on an internal surface of said second hook construction;
  (ii) said second deflection surface forming an angle of about 40 to 50 degrees to a plane parallel to said top wall;
  (iii) said second hook construction further comprising a second engagement surface, said second engagement surface and said second deflection surface joining at a second tip;
  (iv) said first and second hook constructions for operably mounting and locking said slider device onto the resealable closure mechanism;

(e) a channel defined by said first and second hook constructions between said first tip and said second tip;

(f) a guide construction depending from said top wall said guide construction including first and second fingers; said first finger positioned at a first end of said slider device; and said second finger positioned at a second end of said slider device.

23. A slider device according to claim 22, wherein:

(a) said top wall defines an open aperture;
  (i) a first portion of said top wall extending between said first end and said open aperture; said first finger depending from said first portion; and
  (ii) a second portion of said top wall extending between said second end and said open aperture; said second finger depending from said second portion.

24. A slider device according to claim 23, wherein:

(a) a portion of said first hook construction is under said open aperture in said top wall; and (b) a portion of said second hook construction is under said open aperture in said top wall.

25. A slider device according to claim 23, wherein:

(a) said spreader comprises first and second angled wedges defining a gap therebetween; said first and second angled wedges depending from said first portion of said top wall.

26. A slider device according to claim 23, wherein:

(a) said spreader comprises first and second angled wedges defining a groove therebetween; said first and second angled wedges depending from said first portion of said top wall.

27. A method of mounting a slider device on a resealable closure mechanism, the closure mechanism comprising first and second interlocking closure profiles, each of the first and second interlocking closure profiles comprising a mating closure member, a sealing flange, and an upper flange; the slider device comprising a top wall and first and second hook constructions projecting from the top wall, each of the first and second hook constructions having a hook length and comprising a deflection surface positioned on an internal surface of the hook construction and extending the hook length, and an engagement surface, each of the deflection surfaces being at an angle of 40 to 50 degrees to a plane parallel to the top wall, and an area between the first and second hook constructions for receiving the first and second interlocking closure profiles; said method comprising:

(a) contacting the upper flanges of the closure profiles against the deflection surfaces; and (b) urging the closure profiles against the deflection surfaces and between the hooking constructions into the area between the first and second hook constructions.

28. A method according to claim 27, wherein said step of urging the closure profiles against the deflection surfaces and between the hooking constructions into the area between the first and second hook constructions comprises:

(a) deflecting at least one of the first and second hook construction to expand the area between the first and second hook constructions.

* * * * *